United States Patent [19]

Osman

[11] 4,019,236

[45] Apr. 26, 1977

[54] CRIMPING PRESS CLAMP FOR ELECTRICAL CONNECTORS

[75] Inventor: Lloyd Carl Osman, Sunbury, Pa.

[73] Assignee: AMP Incorporated, Harrisburg, Pa.

[22] Filed: Dec. 31, 1975

[21] Appl. No.: 645,723

[52] U.S. Cl. ..... 29/753; 72/460; 29/281.1

[51] Int. Cl.[2] ..... H01R 43/04

[58] Field of Search ..... 72/293, 460; 29/282, 29/203 DT, 203 DS, 203 P; 192/131 R

[56] References Cited

UNITED STATES PATENTS

| | | | |
|---|---|---|---|
| 2,827,940 | 3/1958 | Davis et al. | 29/203 DT X |
| 3,350,765 | 11/1967 | Karl | 29/203 DS |
| 3,402,452 | 9/1968 | Mraz | 29/203 DT |
| 3,769,704 | 11/1973 | Abarotin et al. | 29/203 DT X |
| 3,791,496 | 2/1974 | Emrick | 192/131 R X |
| 3,866,291 | 2/1975 | Heuser et al. | 29/203 DT X |
| 3,931,671 | 1/1976 | Dittmann | 29/203 DT |

*Primary Examiner*—Frank T. Yost
*Attorney, Agent, or Firm*—Allan B. Osborne

[57] ABSTRACT

This invention relates to a press useful for terminating or crimping an electrical connector to a cable. More particularly the press includes die members which crimp the connector about the cable. The press further contains a lever arm adapted to securely hold the connector in crimping position so that conventional guards normally employed with crimping presses are not now necessary.

1 Claim, 4 Drawing Figures

CRIMPING PRESS CLAMP FOR ELECTRICAL CONNECTORS

BACKGROUND OF THE INVENTION

All types of electrical connectors are attached to ends of wires by crimping a suitable portion of the connector; e.g., a wire barrel around the wire with sufficient force to permanently join the connector and wire. Rapid semi- or fully automatic crimping operations require the use of power actuated presses. Such presses in turn require suitable safety guards to prevent injury to the operators. One type of guard involved was placing plastic guards across the front with a hole therethrough. The operator had to place the connector on the end of the wire, pass that loose assembly through the hole and remotely guide it onto the press anvil. Then, while still holding onto the length of cable the operator hit the foot button to operate the press. Obviously this method resulted in very slow application rates and in addition, many connectors would be improperly crimped due to being shifted slightly by the operator due to fatigue, disinterest and so forth. The solution to this problem basically required the means which would result in removing the plastic guards, having the operator place the loose assembly directly onto the anvil, securely holding the assembly mechanically and then requiring the use of both hands at a remote station to energize the press.

Accordingly the present invention provides a crimping press which includes a lever arm which locates and securely holds the loose assembly on the press anvil and which further requires the operator to push two widely spaced buttons simultaneously to actuate the press.

DESCRIPTION OF THE PREFERRED EMBODIMENT

Figure 1:
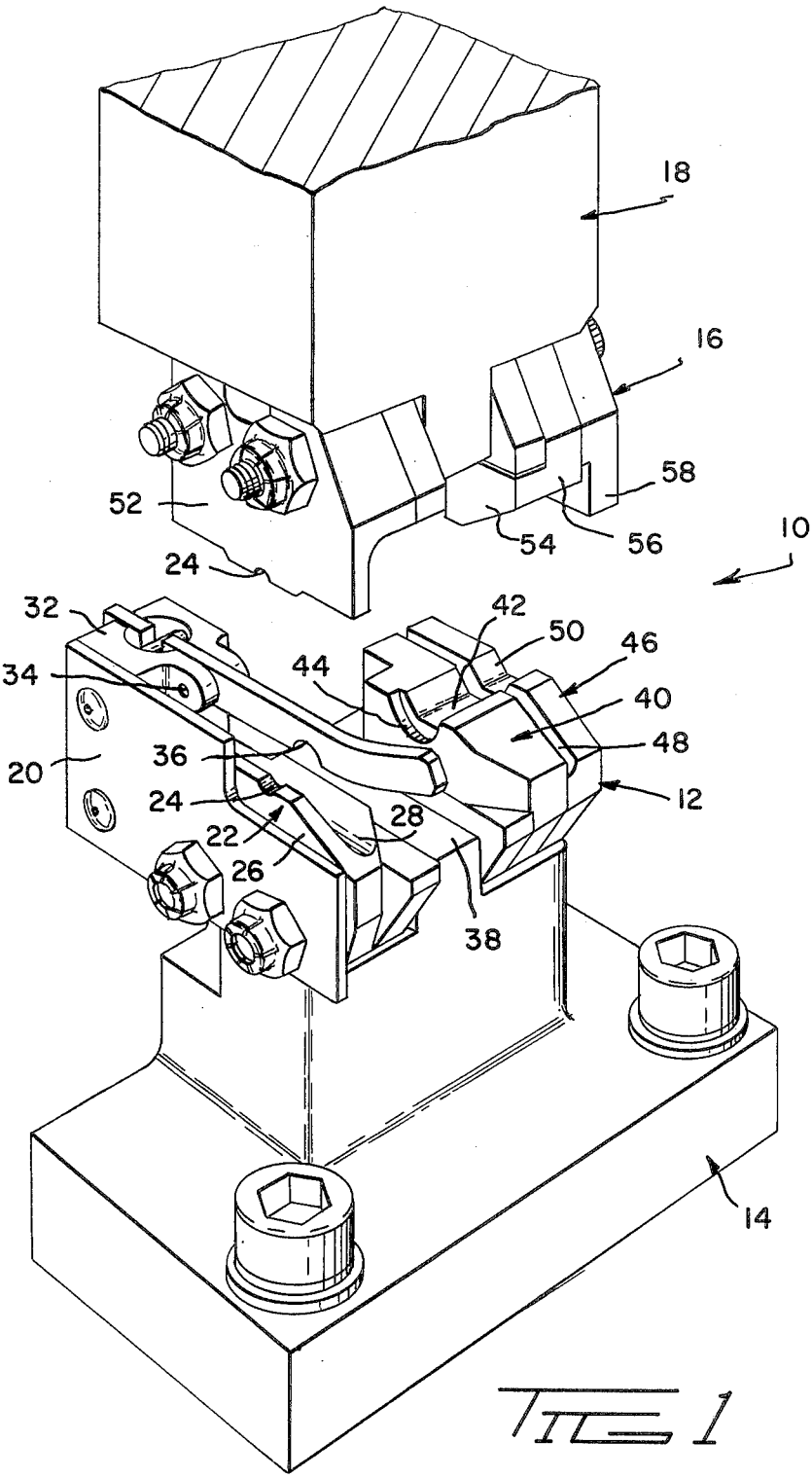
FIG. 1 is a perspective view of the crimping press incorporating the present invention.

Crimping press 10, appearing in FIGS. 1 and 3–5 embody many elements found in conventional presses. the crimping die anvil assembly 12 rests on a pedestal-base 14 which may be bolted to the press frame (FIG. 5). The crimping die nest assembly 16 is removably mounted on the bottom of a reciprocating ram 18. As is well known in the art, crimping of a connector about a wire occurs by advancing ram 18 toward the base 14 whereby the anvil assembly 12 and nest assembly 16 squeeze the appropriate portions of the connector between them to affect the crimp. Whereas presses such as crimping press 10 crimp many types of connectors onto many types of wires and cables, crimping press 10 has been developed to crimp UHF connectors about coaxial cable. Thus the following description will be concerned about such connectors. However, it is to be understood that the invention can be applied to most any type of crimping press.

With specific reference to FIG. 1, the anvil assembly 12 includes a front plate 20 behind which is center pin anvil 22 of the center pin crimping die. A notch 24 having two sides at right angles to each other occupy generally the center of the upper edge of a vertical wall 26. A shelf 28 extends rearwardly from the base of the wall. A spring biased lever arm 30, positioned over the shelf 28, extends laterally from a spring housing 32 located to one side of the center pin anvil and behind plate 20. The arm is pivotably mounted to the spring housing by pin 34. The lower edge of the lever arm contains a rounded indent 36.

A recess 38 separates center pin anvil 22 from ferrule anvil 40 of the ferrule crimping die. The ferrule anvil has on its uper surface a three-sided notch 42 with an arcuate relief 44 immediately in front.

The insulation anvil 46 is located behind ferrule anvil 40, separated therefrom by a gap 48. A three-sided notch 50 crosses the upper surface of the insulation anvil.

The three notches 24, 42 and 50 are concentric but lie at different elevations with respect to the base so as to accommodate the various portions of the UHF connector as will be seen below.

The nest assembly 16 contains the center pin nest 52, a recess 54, ferrule nest 56 and insulation nest 58. Generally the nests reflect the same structure as the anvils 22, 40 and 46 and also contain identical notches 24, 42 and 50. Two exceptions are (1) there is no shelf on the center pin nest 52 and (2) no lever arm 30 and its accouterments. The absence of the shelf provides space for the lever arm as the nest assembly 16 is brought down onto the anvil assembly 12.

Figure 2:
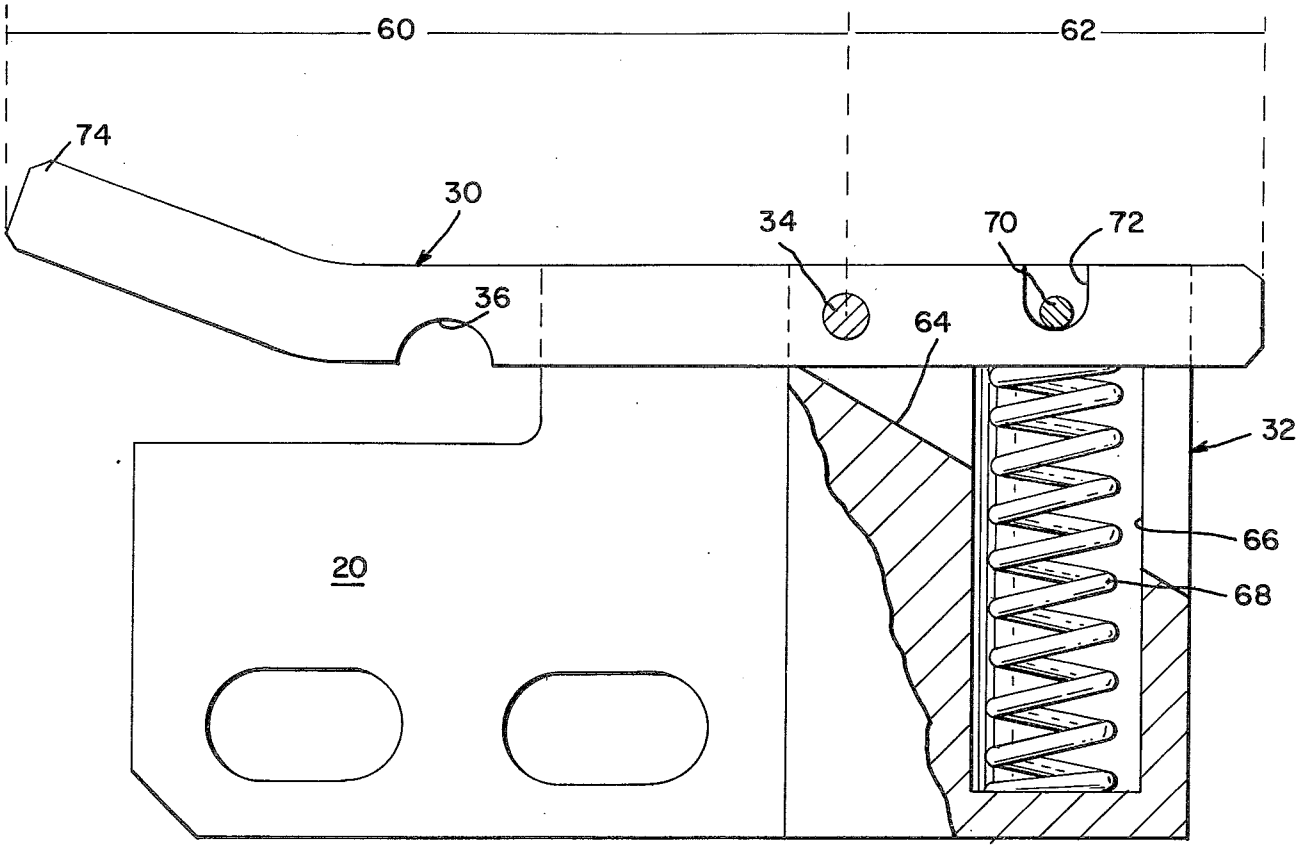
FIG. 2 is an elevation, partially cross-sectioned view of the present invention.

FIG. 2 shows the details to the lever arm 30. The view shown is looking at this unit from the back of the press and is sectioned, such sectioning being normal to the longitudinal axis of the anvil assembly 12.

Using the pivot pin 34 as the dividing point, lever arm 30 can be described as having a handle section 60 to the left of the pin and a biased section 62 to the right. The biased section is contained within a slot 64 which bisects housing 32 and which deepends towards its right side.

A deep aperture 66 is provided in the housing and therein resides coil spring 68. As the drawing shows, the spring bears against the bottom edge of the biased section 62 of the lever arm. A pin 70, anchored in the housing 32 and crossing the aperture 66 and over the biased section through notch 72, limits the angular movement of the arm in one direction. The bottom of slot 64 limits the movement in the other direction.

The handle section 60 of the lever arm 30 has an upwardly angled free end 74 to facilitate sliding a UHF connector inbetweem the arm and the center pin anvil 22.

Figure 3:
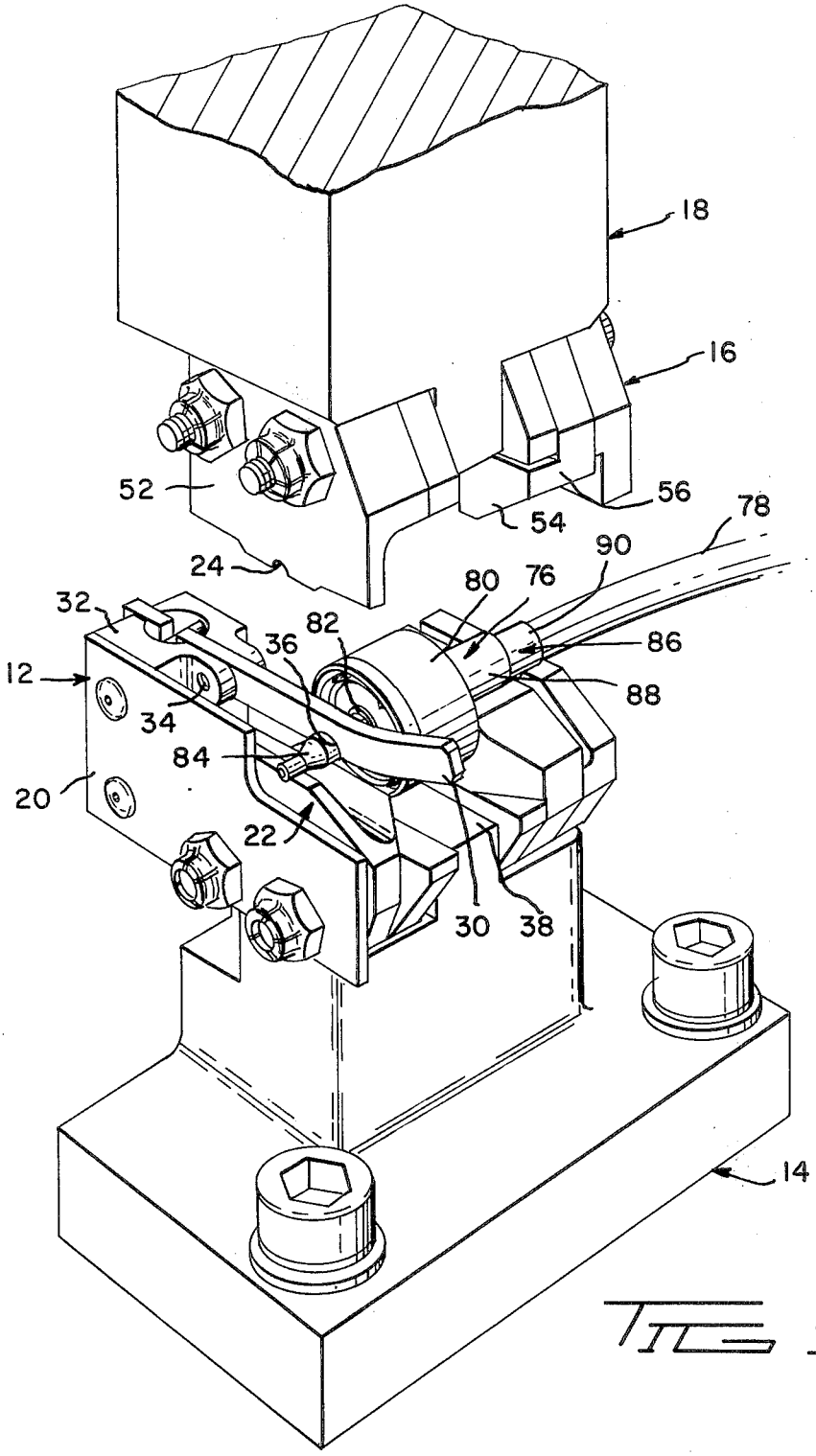
FIG. 3 is a perspective view of the crimping press of FIG. 1 fully loaded with a connector.

FIG. 3 shows the press 10 of FIG. 1 with the addition of a UHF connector 76 positioned in the anvil assembly 12. A coaxial cable 78 has been loosely fitted into connector 76 preparatory to the crimping operation. The connector components include the coupling nut 80, shell member and dielectric unit 82, center pin 84 and ferrule member 86. The ferrule member includes a braided shield section 88 and insulating section 90. The forward end of center pin 84 lies in notch 24 in anvil 22, the ferrule's braided section 88 lies in notch 42 in anvil 40 and the ferrule's insulating section 90 lies in notch 50 in anvil 46. The coupling nut 80 occupies recess 38. Under the biasing of coil spring 68, handle section 60 of lever arm 30 bears down against the center pin which is lodged in indent 36. Clearly the UHF connector 76 is securely restrained between the lever arm and the three notches on the anvil assembly.

Figure 4:
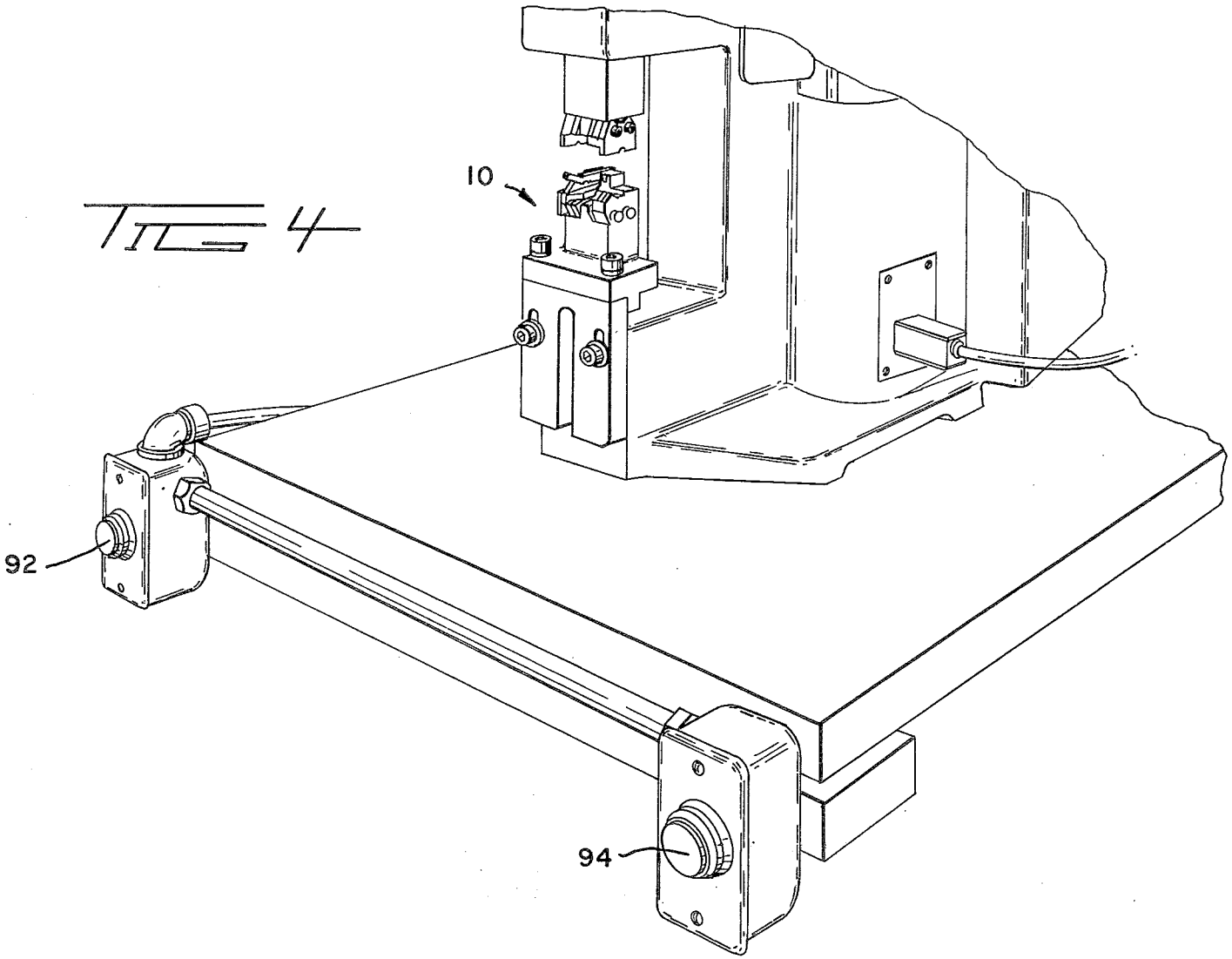
FIG. 4 is a perspective view of the crimping press of FIG. 1 and the dual buttons required for the press operation.

FIG. 4 illustrates the crimping press 10 provided with dual electrical push buttons 92 and 94. Both buttons need to be pushed simultaneously to actuate press 10. Clearly, the spaced buttons means that the operator must use both hands to depress the buttons together. With the addition of lever arm 30, the use of such buttons is feasible.

In actual use of the press employing the present invention, a thirty percent increase in application rates were achieved. Further, misalignments have been eliminated. Obviously crimping press 10 reduces the cost of a terminated coaxial cable.

The foregoing detailed description has been given for clearness of understanding only, and no unnecessary limitation should be understood therefrom, as some modifications will be obvious to those skilled in the art.

I claim:

1. A device for removably retaining a connector on an anvil assembly of an operator-actuated crimping press, comprising:

a. a plate adapted to be fastened to the anvil assembly;

b. a housing secured to the plate and having a vertical aperture therein and a slot bisecting the housing and aperture, said slot being in a direction perpendicular to the longitudinal axis of the anvil assembly;

c. an elongated arm having first and second ends and pivotally mounted in slot with the pivot point being inwardly from the first end and with the second end extending across the anvil assembly and towards an operator who may be positioned at the crimping press;

d. an indent located on the lower edge of the second end of the arm, said indent being conformable to and in registration with a connector which may be positioned on the anvil assembly; and e. biasing means positioned in the vertical aperture and bearing against the first end of the arm and thereby biasing the second end downwardly against a connector which may be positioned on the anvil assembly to retain it thereon, said connector being releasable therefrom by the operator raising the second end of the arm.

* * * * *